United States Patent [19]

Yoshino

[11] Patent Number: 4,731,102

[45] Date of Patent: Mar. 15, 1988

[54] OXYGEN GAS PRODUCTION APPARATUS

[75] Inventor: Akira Yoshino, Osaka, Japan

[73] Assignee: Daidousanso Co., Ltd., Osaka, Japan

[21] Appl. No.: 53,293

[22] PCT Filed: Aug. 8, 1986

[86] PCT No.: PCT/JP86/00409

§ 371 Date: Apr. 7, 1987

§ 102(e) Date: Apr. 7, 1987

[87] PCT Pub. No.: WO87/01184

PCT Pub. Date: Feb. 26, 1987

[30] Foreign Application Priority Data

Aug. 12, 1985 [JP] Japan ..... 60-178232

[51] Int. Cl.[4] ..... F25J 3/00

[52] U.S. Cl. ..... 62/11; 62/18; 62/39; 62/40; 62/42

[58] Field of Search ..... 62/9, 11, 32, 36–42, 62/18

[56] References Cited

U.S. PATENT DOCUMENTS

| | | | |
|---|---|---|---|
| 2,940,269 | 6/1960 | Frainier | 62/38 |
| 3,039,274 | 6/1962 | Matsch | 62/11 |
| 3,735,599 | 5/1973 | Izumichi et al. | 62/18 |
| 4,526,595 | 7/1985 | McNeil | 62/39 |
| 4,529,425 | 7/1985 | McNeil | 62/39 |

*Primary Examiner*—Ronald C. Capossela

*Attorney, Agent, or Firm*—Armstrong, Nikaido, Marmelstein & Kubovcik

[57] ABSTRACT

The invention provides an apparatus for production of highly pure oxygen gas by cryogenic liquefaction and separation of air which does not include an expansion turbine which is known to frequently cause operation troubles. The apparatus comprises an oxygen gas production apparatus comprising an air compression means for compressing air from an outside source, a purification means for removing carbon dioxide gas and water vapor from the air compressed by said air compression means, a heat exchange means for chilling the compressed air from said purification means to a cryogenic temperature, a fractionation column for liquefying and fractionating the compressed air chilled to a cryogenic temperature by said heat exchange means and holding nitrogen in gaseous state and oxygen in liquid state, a liquid oxygen storage means for receiving liquid oxygen from an outside source and storing the same, a line for continuously introducing into said fractionation column the liquid oxygen from said liquid oxygen storage means in lieu of the generated refrigeration from a cold heat generating expansion means, an oxygen gas withdrawal line for guiding the liquid oxygen within said fractionation column as a refrigerant to said heat exchange means and withdrawing the gasified oxygen produced by heat exchange as a product oxygen gas, and a pressurizing means for pressurizing the product oxygen gas withdrawn from said oxygen withdrawal line.

2 Claims, 6 Drawing Figures

OXYGEN GAS PRODUCTION APPARATUS

BACKGROUND OF THE INVENTION

1. Field of the Invention

The present invention relates to an oxygen gas production apparatus which provides high purity gaseous oxygen in pressurized state.

2. Description of the Prior Art

It is customary to produce oxygen gas in an air fractionation plant which separates oxygen from nitrogen by taking advantage of their difference in boiling point. This conventional air fractionation plant is provided with an expansion turbine for generating the refrigeration necessary for the liquefaction and fractionation of air, which utilizes the "cold heat" due to adiabatic expansion.

However, because of its extremely high speed (tens of thousand revolutions per minute), the expansion turbine cannot delicately follow variations in load (variations in the rate of withdrawal of product oxygen gas). Thus, it is technically difficult to vary the rotational speed of the expansion turbine quickly and accurately in response to changes in the amount of withdrawal of product oxygen gas so as to maintain the compressed material air at a constant temperature at all times. As a result, a variation is inevitable in the purity of product oxygen gas, for low purity oxygen is frequently output to depress the overall purity of product oxygen. Furthermore, because it is driven at a very high speed, the expansion turbine demands high mechanical precision and is costly to manufacture. In addition, its complicated structure calls for specially trained maintenance personnel. These problems emanate generally from the high-speed-revolving component of the expansion turbine and there has been a strong demand for elimination of an expansion turbine having such a high-speed revolving element from the oxygen production installation.

While product gaseous oxygen is sent to points of consumption via the product oxygen gas withdrawal line of the air fractionation plant, this transport is smoothly carried out when the pressure of product oxygen gas is high. Moreover, pressurized product oxygen gas is more convenient for consumption.

Accomplished in view of the above state of the art, the present invention is directed to:

(1) an oxygen gas production apparatus comprising an air compression means for compressing air from an outside source, a purification means for removing carbon dioxide gas and water vapor from the air compressed by said air compression means, a heat exchange means for chilling the compressed air from said purification means to a cryogenic temperature, a fractionation column for liquefying and fractionating the compressed air chilled to a cryogenic temperature by said heat exchange means and holding nitrogen in gaseous state and oxygen in liquid state, a liquid oxygen storage means for receiving liquid oxygen from an outside source and storing the same, a line for continuously introducing into said fractionation column the liquid oxygen from said liquid oxygen storage means in lieu of the generated refrigeration from a cold heat generating expansion means, an oxygen gas withdrawal line for guiding the liquid oxygen within said fractionation column as a refrigerant to said heat exchange means and withdrawing the gasified oxygen produced by heat exchange as a product oxygen gas, and a pressurizing means for pressurizing the product oxygen gas withdrawn from said oxygen withdrawal line; and (2) an oxygen gas production apparatus comprising an air compression means for compressing air from an outside source, a purification means for removing carbon dioxide gas and water vapor from the air compressed by said air compression means, a heat exchange means for chilling the compressed air from said purification means to a cryogenic temperature, a fractionation column for liquefying and fractionating the compressed air chilled to a cryogenic temperature by said heat exchange means and holding nitrogen in gaseous state and oxygen in liquid state, a liquid oxygen storage means for receiving liquid oxygen from an outside source and storing the same, a line for continuously introducing into said fractionation column the liquid oxygen from said liquid oxygen storage means in lieu of the generated refrigeration from a cold heat generating expansion means, a liquid oxygen withdrawal line for withdrawing liquid oxygen from said fractionation column, a pressurizing means for pressurizing the liquid oxygen from said liquid oxygen withdrawal line, and an oxygen gas withdrawal line for guiding the liquid oxygen pressurized by said pressurizing means to said heat exchange means as a refrigerant and withdrawing the gasified oxygen produced by heat exchange as a product oxygen gas.

The advantages of the oxygen gas production apparatus according to the present invention include the following. Firstly, because it does not include an expansion turbine but, instead, uses a liquid oxygen storage means, such as a liquid oxygen storage tank, which has no revolving part, the whole equipment is virtually free of operation troubles and failures. Moreover, whereas the expansion turbine is an expensive machine, the liquid oxygen storage tank is available at low cost and does not call for special maintenance personnel. The expansion turbine is further disadvantageous in that since it cannot be easily driven to follow variations in load faithfully, i.e. at a varying rotational speed commensurate with the varying rate of withdrawal of product oxygen gas, the compressed air cannot be chilled to a predetermined temperature at all times. In contrast, the apparatus according to the present invention includes a liquid oxygen storage means in lieu of an expansion turbine and uses liquid oxygen which can be supplied at delicately controlled rates as a refrigeration medium so that product oxygen gas of very high purity can be obtained on a constant basis. In addition, because this apparatus is provided with a pressurizing means, the high-purity product oxygen can be made available in pressurized condition which is convenient in use at points of consumption. Particularly, the above principle of pressurizing liquid oxygen results in a remarkable improvement in the efficiency of compression, leading to drastic reductions in oxygen gas production cost and equipment scale. Moreover, since a liquid can be more easily compressed than a gas, the required seal may be less positive, so that it is easier to prevent oxygen leaks. In other words, the leakage of oxygen can be completely inhibited. Therefore, the present invention is a remarkable step forward from the standpoint of prevention of explosion and other hazards as well.

DETAILED DESCRIPTION OF THE INVENTION

Figure 1:
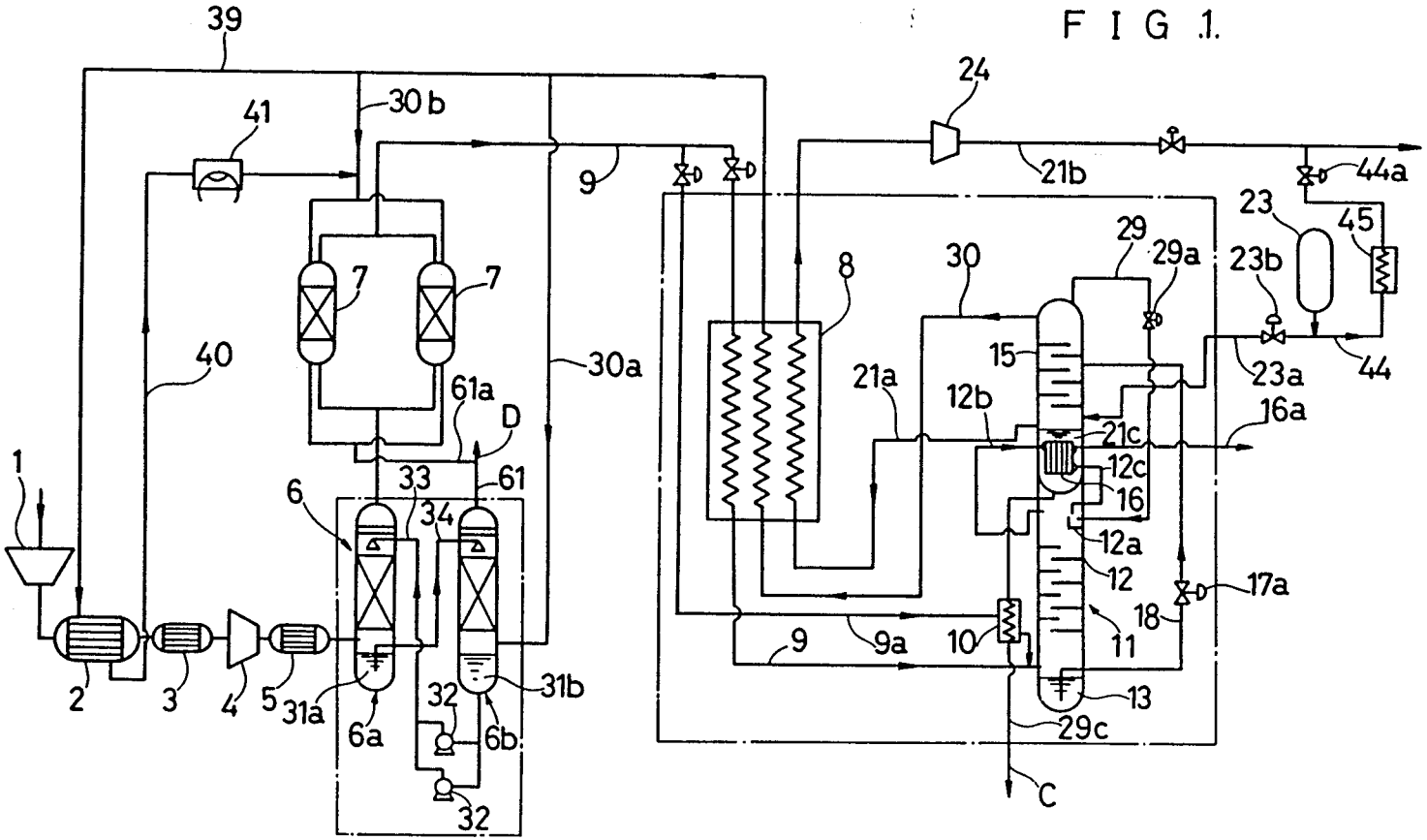
FIG. 1 is an elementary view showing an embodiment of the present invention.

The present invention will be described below, taking preferred embodiments as examples. Referring to FIG. 1, which shows an embodiment of the present invention, the apparatus generally comprises a first air compressor 1, a waste heat recovery unit 2, an intercooler 3, a second air compressor 4, an aftercooler 5, and a couple of air cooling columns 6, one of which (6*a*) is closed with the other (6*b*) communicating with an exhaust pipe 61. The apparatus further comprises a couple of adsorption columns 7, which are packed with molecular sieves and alternately operated to adsorb $H_2O$ and $CO_2$ in the air compressed by said first and second air compressors 1 and 4. The reference numeral 8 represents a first heat exchanger which is supplied with the compressed air freed of $H_2O$ and $CO_2$ by said adsorption column 7 via a compressed air supply pipe 9 and by which said compressed air is chilled to a cryogenic temperature.

The reference numeral 10 represents a second heat exchanger which is supplied with the compressed air freed of $H_2O$ and $CO_2$ through a branch pipe 9*a* branching out from said compressed air supply pipe 9. The compressed air fed into this second heat exchanger 10 is also chilled to a cryogenic temperature by heat exchange and, then, converges with the cryogenic compressed air from said first heat exchanger 8. The oxygen production apparatus according to this embodiment further includes a fractionation column 11, a bottom column of which is indicated at 12. In this fractionation column, the compressed air chilled to a cryogenic temperature by said first and second heat exchangers 8, 10 and supplied via the pipe 9 is further chilled and a portion thereof is liquefied and pooled in the bottom as liquefied air 13, while nitrogen (containing small amounts of He, etc.) alone being held in gaseous state in the top. The reference numeral 15 represents a top column segment of said fractionation column 11 and has a built-in condenser 16. This condenser 16 is supplied with a portion of nitrogen gas (containing small amounts of He gas, etc.) pooled in the top of the bottom column segment 12 of said fractionation column 11 via a pipe 12*b* and the nitrogen gas having a boiling point higher than that of He gas is liquefied and sent to a liquid nitrogen basin 12*a* in the bottom column segment 12 via a pipe 12*c*, while the lower-boiling He gas is released as it is into the atmosphere via a pipe 16*a*. The inside of said top column segment 15 is maintained in relatively decompressed condition as compared with the inside of said bottom column segment 12, and the liquefied air (50–70% $N_2$, 30–50% $O_2$) 13 pooled in the bottom of said bottom column 12 is introduced into the intermediate segment via a pipe 18 fitted with an expansion valve 17*a*, whereby its low-boiling fraction nitrogen is gasified and the liquid oxygen 21*c* collects in the bottom of the column segment 15. In this connection, a portion of liquid nitrogen pooled in the liquid nitrogen basin 12*a* within the bottom column component 12 is sent to the top column component 15 via a pipe 29 fitted with an expansion valve 29*a* for use as a reflux fluid in the top column segment 15. The reference numeral 30 represents a waste nitrogen gas withdrawal pipe for withdrawing the nitrogen fraction (not so high in purity) collected in the top of the top column segment 15 as waste nitrogen gas. This waste nitrogen gas is guided to the first heat exchanger 8 where the material air is chilled by the refrigeration to a cryogenic temperature. The nitrogen gas is then guided to the cooling column 6*b* in the cooling column set 6 via a branch pipe 30*a*, where it is cooled by showers of water ejected from the tip nozzle of a pipe 34. The waste nitrogen gas which has thus undergone heat exchange is released from a pipe 61 into the atmosphere as indicated by arrowmark D. In this connection, a portion of the waste nitrogen gas taken out from the top column segment 15 via the pipe 30 is utilized for regeneration of the one of said adsorption columns 7 which is not acting. Thus, the cryogenic waste nitrogen gas is guided from the pipe 30 to the waste heat recovery unit 2 via a pipe 39 and the resultant nitrogen gas at elevated temperature is fed to a regeneration heater 41 via a pipe 40 to further increase its temperature. The heated nitrogen gas is fed to the idle adsorption column for regeneration of its molecular sieve and, then, released into the atmosphere via pipes 61*a* and 61 as indicated by arrowmark D. The above-mentioned molecular sieve is little adsorbent at high temperature but displays a high adsorptive affinity at low temperature. Accordingly the molecular sieve just regenerated as above is so high in temperature that it cannot exhibit its expected adsorptive performance. Therefore, after passage of the high-temperature waste nitrogen gas, the low-temperature waste nitrogen gas from a pipe 30*b* is introduced to cool the molecular sieve and the waste nitrogen gas is released into the atmosphere as indicated by arrowmark D. The regeneration cycle is thus completed. The two adsorption columns 7 are alternately regenerated in the above manner. The water 31*b* cooled by waste nitrogen gas in the cooling column 6*b* collects in the bottom of the column 6*b* and is sent by a pump 32 via a pipe 33 into the top of the closed cooling column 6*a*, where it flows down in the manner of a shower to cool the material air fed from said first and second air compressors 1, 4. The water 31*a* which has completed this cooling operation is returned to the cooling column 6*b* by the pressure gradient and cooled again by the refrigeration provided by waste nitrogen gas. To the bottom of said top column segment 15 is introduced a liquid oxygen via a pipe 23*a* from a liquid oxygen storage tank 23 which is supplied with liquid oxygen from an external source and stores it, and this liquid oxygen is used to cool the condenser 16 built into the top column segment 15. Indicated at 21*a* is a gaseous oxygen withdrawal pipe for withdrawing the gasified fraction of liquid oxygen 21*c* pooled in the bottom of the top column segment 15. This pipe receives the gaseous oxygen taken at a level slightly above the level of liquid oxygen 21*c* (purity 99.5%) and transports it to the first heat exchanger 8 where the oxygen gas is adjusted to atmospheric temperature by heat exchange with compressed air feed and sent to the product oxygen withdrawal pipe 21*b*. Indicated at 29*c* is a disposal pipe for disposing of the liquid oxygen 21*c* collected in the bottom of the top column segment 15. This pipe sends the liquid oxygen 21*c* to the second heat exchanger 10 where it undergoes heat exchange with material air to chill the latter to a cryogenic temperature, after which it is released as indicated by arrow-mark C. The reference numeral 24 represents a compression means comprising an oxygen gas compressor disposed in the product oxygen gas withdrawal pipe 21*b*. This compression means pressurizes the product oxygen gas to a prescribed pressure so that the product oxygen gas may be obtained in pressurized state.

The reference numeral 44 represents a backup system line which opens a valve 44*a* in the event of a failure of the air compression system line, whereby the liquid oxygen in the liquid oxygen storage tank 23 is vaporized in an evaporator 45 and sent into the pipe 21*b* so as to prevent interruption of oxygen gas feed. Indicated by a dot-broken line is a vacuum cold housing which prevents entry of heat from outside for a further improvement of purification efficiency.

The apparatus described above produces product oxygen gas in pressurized state in the following manner.

The air is compressed by the air compressor 1 and the resulting heat is recovered by the waste heat recovery unit 2. The compressed air is cooled by the intercooler 3, compressed by the air compressor 4, further cooled by the after-cooler 5 and sent to the closed cooling column 6*a* where it is contacted in counter current with the water cooled by waste nitrogen gas. The cooled air is fed to the adsorption column 7 wherein $H_2O$ and $CO_2$ are adsorbed and removed. A portion of the compressed air freed of $H_2O$ and $CO_2$ is fed via the pipe 9 into the first heat exchanger 8 where it is chilled to a cryogenic temperature, while the remainder is fed via the branch pipe 9*a* into the second heat exchanger 10 where it is chilled to a cryogenic temperature. The two cryogenic air streams are combined and fed into the bottom of the bottom column segment 12. This compressed air is distilled by counter-current contact with overflowing liquid nitrogen from the liquid nitrogen basin 12*a* to liquefy the oxygen fraction and pool it in the bottom of the bottom column segment 12. In this process, by the difference in boiling point between nitrogen and oxygen (oxygen boils at −183° C. and nitrogen boils at −196° C.), the higher-boiling oxygen fraction of the compressed air is liquefied, while the nitrogen fraction remains gaseous. Accordingly the oxygen-rich liquefied air 13 collects in the bottom of the bottom column segment 12. The liquefied air 13 collected in the bottom of the bottom column segment 12 is subjected to adiabatic expansion at the expansion valve 17*a* and sprayed from the pipe 18 into the top column segment 15, where it contacts with the liquid nitrogen supplied into the top of the column segment 15 from the liquid nitrogen basin 12*a* and flows down to the bottom of the column segment 15. Here, by the same boiling point differential between nitrogen and oxygen as mentioned above, the higher-boiling fraction oxygen is liquefied and collects in the bottom while the nitrogen remains gaseous. Meanwhile, the top column segment 15 is supplied with liquid oxygen as a refrigerant from the liquid oxygen storage tank 23 and this liquid oxygen intermingles with the above liquefied and separated liquid oxygen and the mixture collects in the bottom, and cools the condenser 16 disposed within the top column segment 15. On the other hand, the nitrogen gas separated in the column segment 15 is for the most part drawn out from the waste nitrogen gas withdrawal pipe 30 for use as a refrigerant for the first heat exchanger 8, for preparation of cooling water for the air cooling column 6 and for regeneration of the adsorption column 7. The gas evaporated from the liquid oxygen collected in the bottom of the column segment 15 in the above manner is withdrawn from the gaseous oxygen withdrawal pipe 21*a*, subjected to heat exchange in the first heat exchanger 8, pressurized to a predetermined pressure by the compression means 24 and sent out of the apparatus as an atmosphericrtemperature product gas through the pipe 21*b*. In this manner, high-purity oxygen gas is obtained in pressurized state.

Figure 2:
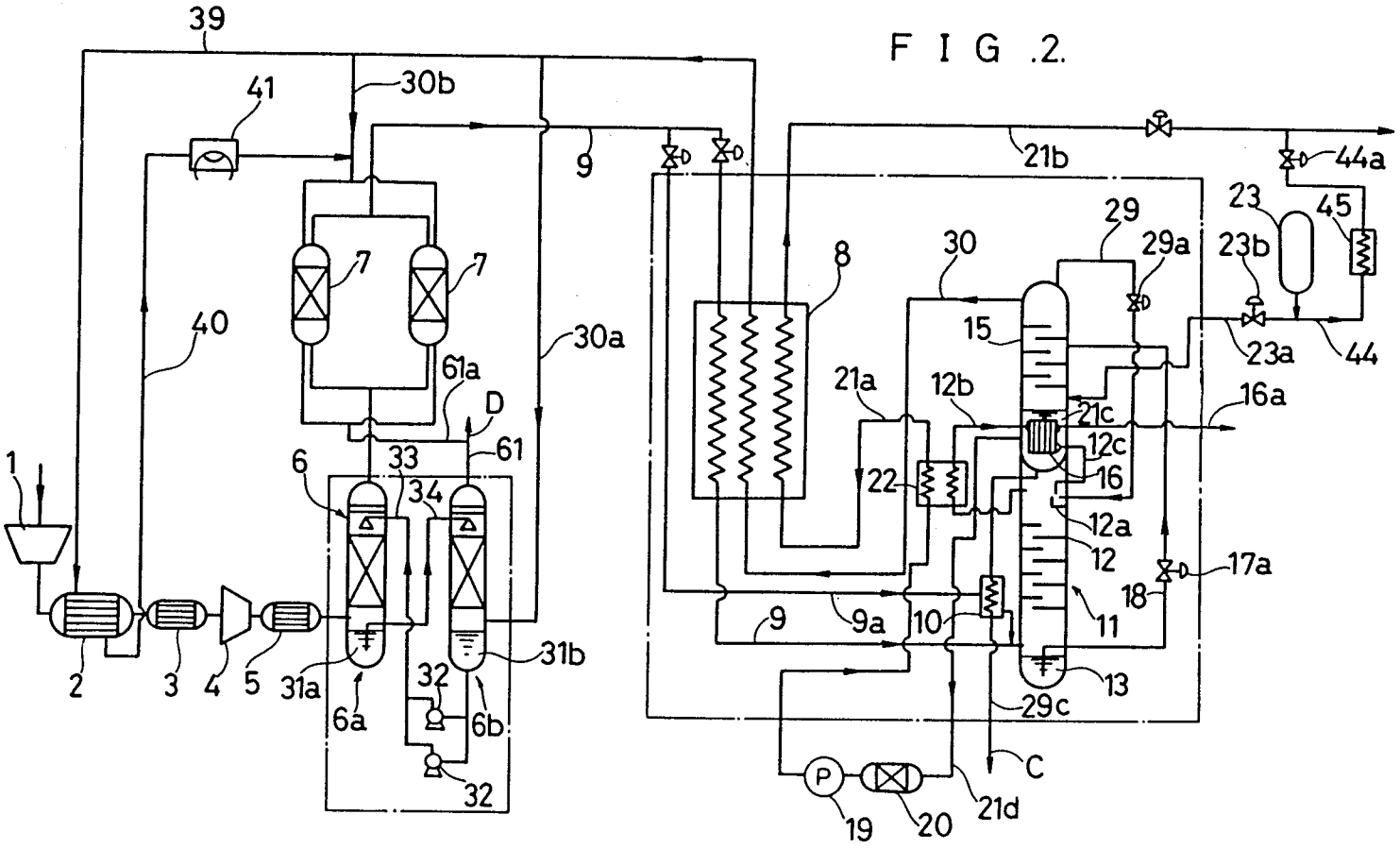
FIG. 2 is an elementary view showing another embodiment of the invention.
Figure 3:
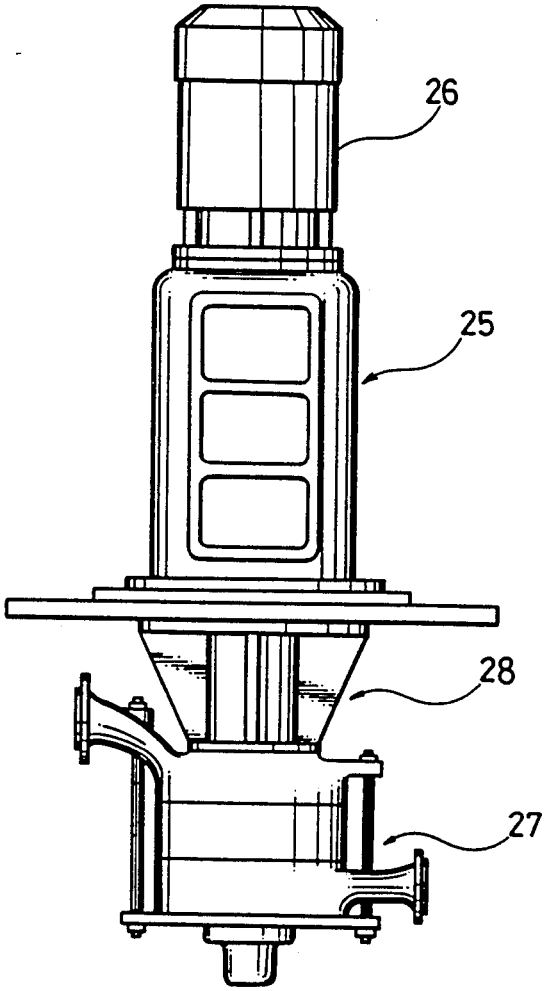
FIG. 3 is a plan view of a liquid oxygen compression pump.
Figure 4:
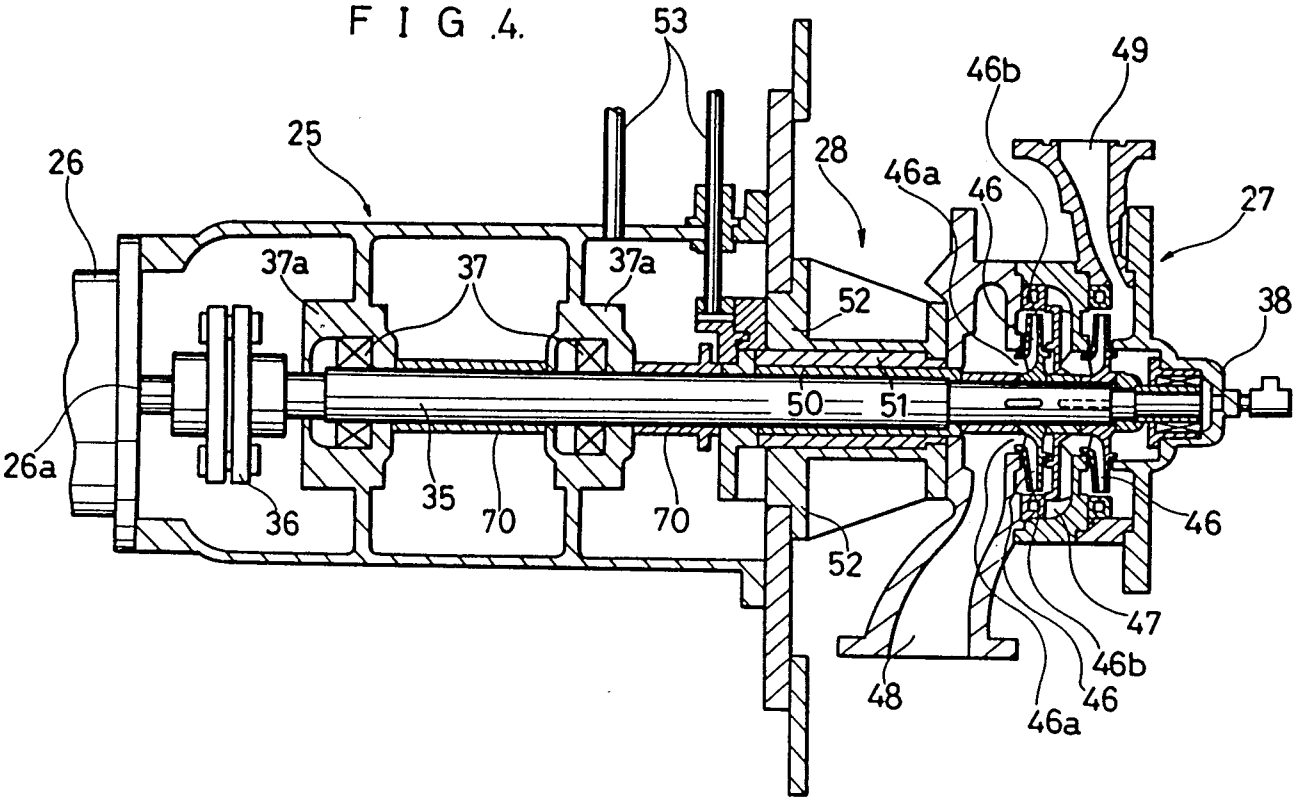
FIG. 4 is a cross-sectional view of the same.

Referring, now, to FIG. 2 which shows another embodiment of the present invention, the oxygen gas production apparatus includes a compression means 19 for pressurizing liquid oxygen in a liquid oxygen withdrawal pipe 21*d* in lieu of the compression means 24 for pressurizing the product oxygen gas, an adsorption column 20 for removal of the impurities such as methane and acetylene which collect in the bottom of a column segment 15, and a third heat exchanger 22. Since the construction of this embodiment is otherwise identical to that of the first embodiment, the same or corresponding parts are indicated by the like numerals. The above-mentioned compression means 19 comprises a liquid oxygen pressurizing pump of the construction illustrated in FIG. 3. This pump comprises a motor mount 25, a high-speed motor 26 mounted on said motor mount, and a compression unit 27 with the interposition of an liquid oxygen leak seal 28. More specifically, as shown in FIG. 4, the pump includes a main shaft 35 which extends through the center of said motor mount 25, liquid oxygen leak seal 28 and compression unit 27 and is connected to a rotary shaft 26*a* of said motor 26 via a coupling 36. This main shaft 35 is rotatably supported by a bearing means 37 secured in position by a bearing cover 37*a* disposed within the motor mount 25 and a bearing 38 disposed at the end of the compression unit 27. The reference numeral 70 represents a sleeve. The compression unit 27 comprises a couple of spiral impellers 46 mounted on said main shaft 35 in upper and lower positions and a casing for accommodating the impellers 46. By the rotation of the main shaft 35, liquid oxygen is taken into a central suction port 46*a* of the impeller 46 and discharged in pressurized state from a peripheral discharge port 46*b*. Thus, as the impellers 46 are driven, the liquid oxygen is taken into a suction nozzle 48, pressurized by the first-stage impeller 46 and, after passage through a passageway 47, further pressurized by the second-stage impeller 46, whereby the liquid oxygen is compressed to a predetermined pressure.

The liquid oxygen leak seal 28 comprises a sleeve 50 surrounding said main shaft 35, a labyrinth 51 disposed around said sleeve 50 and a labyrinth cover 52 disposed further on said labyrinth 51, and serves to prevent leakage of liquid oxygen from the compression unit 27 and entry thereof into the motor mount 25 to cause an explosion. In this connection, said motor mount 25 is divided into three gas-tight compartments so that liquid oxygen which may leak out will not reach the motor. The reference numeral 53 is an oxygen exhaust pipe which discharges liquid oxygen in gaseous state so that even if liquid oxygen leaks out from said seal 28, it will not reach the motor as it is.

The above-mentioned oxygen pressurizing pump pressurizes the liquid oxygen which has been freed of impurities in the adsorption column 20 and sends it to the third heat exchanger 22, where it is heated by heat exchange with the nitrogen gas drawn out from the bottom column segment 12 via the pipe 12*b*. This oxygen is then fed to the first heat exchanger 8 and withdrawn into the product oxygen gas withdrawal pipe 21*b* as an atmospheric-temperature oxygen gas in pressurized state. In this manner, product oxygen gas in pressurized state is obtained.

Thus, whereas oxygen in gaseous state is pressurized in the first embodiment, it is pressurized in liquid state in this embodiment to give a high purity oxygen gas in pressurized state so that the efficiency of pressurization is higher in this embodiment. Thus, the required pressurization can be accomplished with a reduced power, the product gas cost is reduced, and the equipment can be more compact. Thus, since the volume of the gas is as large as 22.4 l per mole, a large-scale equipment is required for compression. In contrast, the liquid is smaller in volume and, therefore, can be pressurized with comparative ease. Particularly, oxygen is so reactive that in gaseous state it reacts with the lubricating oil for the pressurizing pump, for instance, to instantly cause an explosion. In liquid state, however, there is no such accident. Moreover, the seal for the pump is easier and simpler for liquid oxygen than for gaseous oxygen.

Figure 5:
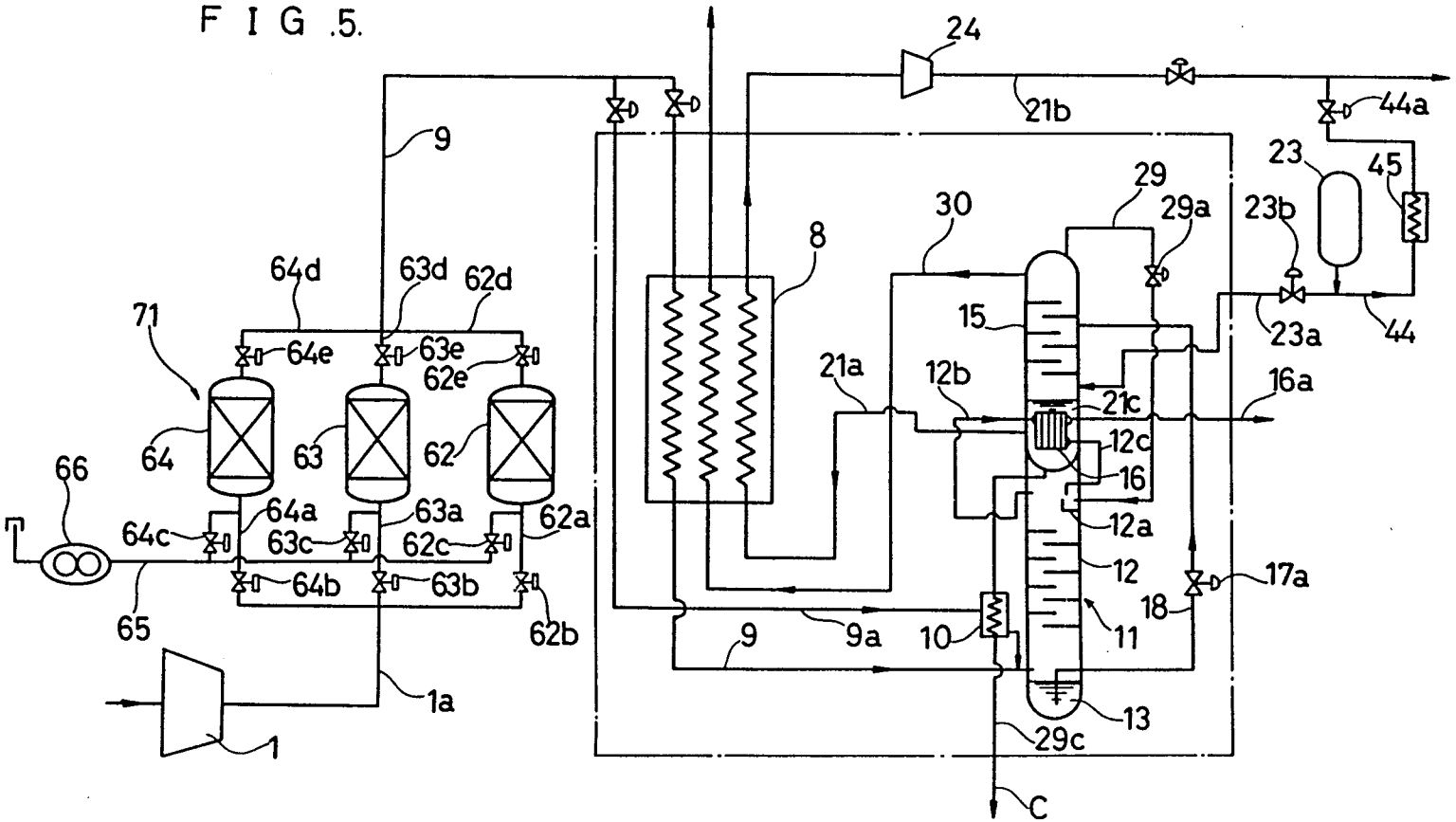
FIGS. 5 and 6 are elementary views illustrating modifications of the embodiments shown in FIGS. 1 and 2.
Figure 6:
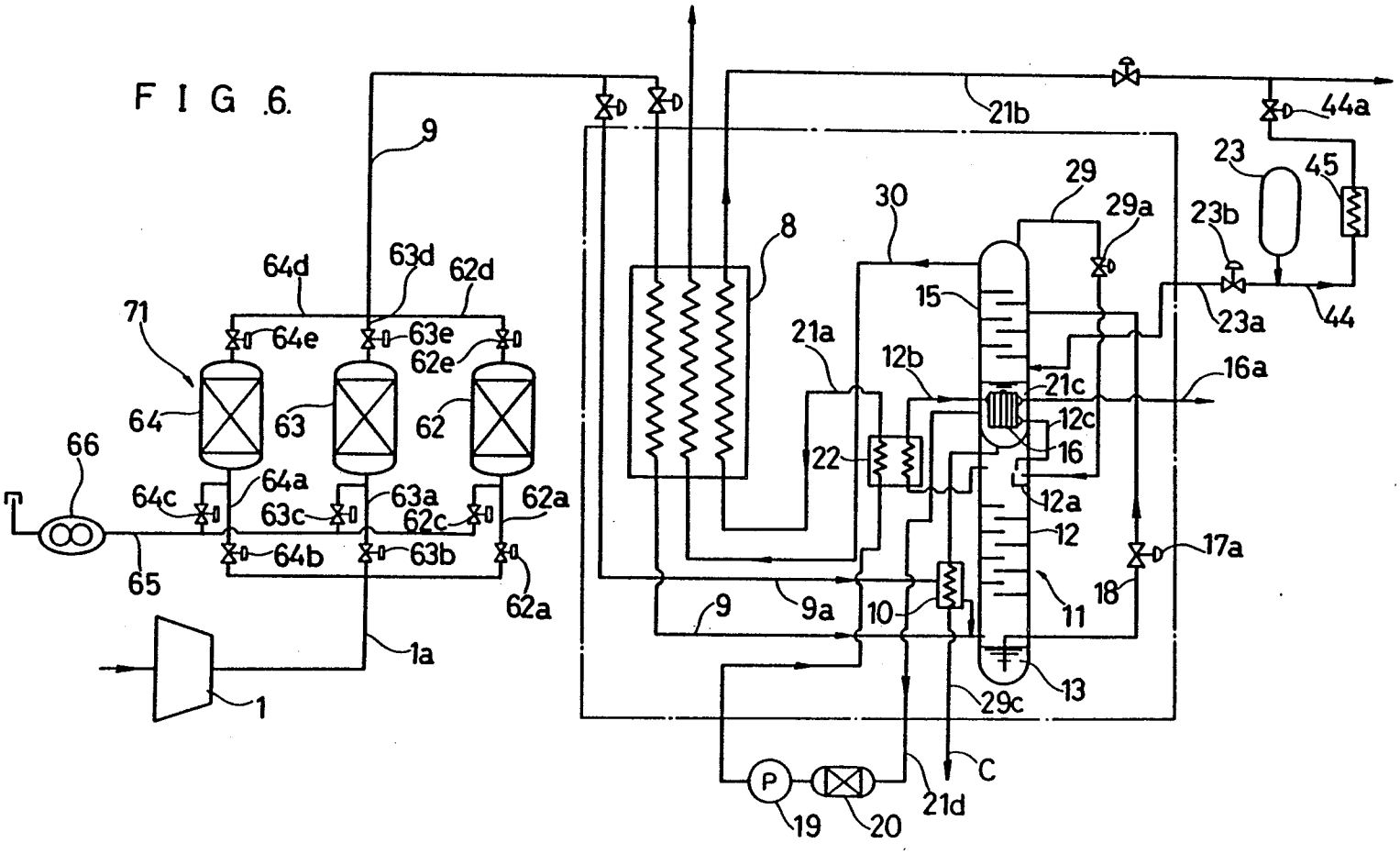

In the apparatus shown in FIG. 1 as an embodiment of the present invention and the apparatus shown in FIG. 2 as another embodiment, material air is first compressed and freed of impurities and, then, directly fed to the fractionation column 11. In lieu of the above arrangement, it may be so arranged that, as shown in FIGS. 5 and 6, material air is preliminarily passed through a nitrogen eliminator 71 to provide an oxygen-rich air, which is then fed to the fractionation column 11. This nitrogen eliminator 71 is described in detail below with reference to FIGS. 5 and 6. The reference numerals 62, 63 and 64 each represents a nitrogen adsorption column packed with an adsorbent (synthetic zeolite, molecular sieve) which selectively adsorbs $N_2$. The inlets of these adsorbent columns are respectively connected to an air compressor pipe 1*a* through lines 62*a*, 63*a* and 64*a* fitted with valves 62*b*, 63*b* and 64*b*, respectively. The reference numeral 66 represents a vacuum pump which is connected to the inlets of said adsorption columns 62, 63 and 64 through a suction line 65 equipped with valves 62*c*, 63*c* and 64*c*. Indicated at 62*d*, 63*d* and 64*d* are discharge lines connected to the exits of said adsorption columns 62, 63 and 64 and provided with valves 62*e*, 63*e* and 64*e*, respectively. These discharge lines 62*d*, 63*d* and 64*d* are connected to a compressed air supply pipe 9. One of said adsorption columns 62, 63 and 64 is used for adsorption at a time, with the other two columns being subjected to vacuum suction regeneration by the vacuum pump 66, and one of the columns so regenerated is then used for adsorption. The above cycle is repeated for continuous adsorption of nitrogen gas. The use of this nitrogen eliminator 71 results in reduced material air requirements and product oxygen gas costs.

I claim:

1. An oxygen gas production apparatus comprising an air compression means for compressing air from an outside source, a purification means for removing carbon dioxide gas and water vapor from the air compressed by said air compression means, a heat exchange means for chilling the compressed air from said purification means to a cryogenic temperature, a fractionation column for liquefying and fractionating the compressed air chilled to a cryogenic temperature by said heat exchange means and holding nitrogen in gaseous state and oxygen in liquid state, a liquid oxygen storage means for receiving liquid oxygen from an outside source and storing the same, a line for continuously introducing into said fractionation column the liquid oxygen from said liquid oxygen storage means for use as a refrigerant for liquefaction of compressed air in lieu of the generated refrigeration from a cold heat generating expansion means, an oxygen gas withdrawal line for guiding the liquid oxygen within said fractionation column as a refrigerant to said heat exchange means and withdrawing the gasified oxygen produced by heat exchange as a product oxygen gas, and a pressurizing means for pressurizing the product oxygen gas withdrawn from said oxygen withdrawal line.

2. An oxygen gas production apparatus comprising an air compression means for compressing air from an outside source, a purification means for removing carbon dioxide gas and water vapor from the air compressed by said air compression means, a heat exchange means for chilling the compressed air from said purification means to a cryogenic temperature, a fractionation column for liquefying and fractionating the compressed air chilled to a cryogenic temperature by said heat exchange means and holding nitrogen in gaseous state and oxygen in liquid state, a liquid oxygen storage means for receiving liquid oxygen from an outside source and storing the same, a line for continuously introducing into said fractionation column the liquid oxygen from said liquid oxygen storage means for use as a refrigerant for liquefaction of compressed air in lieu of the generated refrigeration from a cold heat generating expansion means, a liquid oxygen withdrawal line for withdrawing liquid oxygen from said fractionation column, a pressurizing means for pressurizing the liquid oxygen from said liquid oxygen withdrawal line, and an oxygen gas withdrawal line for guiding the liquid oxygen pressurized by said pressurizing means to said heat exchange means as a refrigerant and withdrawing the gasified oxygen produced by heat exchange as a product oxygen gas.

* * * * *